US007147391B2

(12) United States Patent
Matsushima et al.

(10) Patent No.: US 7,147,391 B2
(45) Date of Patent: Dec. 12, 2006

(54) IMAGE FORMING DEVICE

(75) Inventors: Hirofumi Matsushima, Fujiidera (JP); Hiromasa Yamagishi, Ikoma (JP); Shuji Sakai, Kadoma (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 192 days.

(21) Appl. No.: 10/711,500

(22) Filed: Sep. 22, 2004

(65) Prior Publication Data

US 2005/0063761 A1 Mar. 24, 2005

(30) Foreign Application Priority Data

Sep. 24, 2003 (JP) ..... 2003-331658

(51) Int. Cl.

| | |
|---|---|
| ***B41J 13/03*** | (2006.01) |
| ***B41J 13/10*** | (2006.01) |
| ***B41J 13/036*** | (2006.01) |
| ***B41J 11/04*** | (2006.01) |
| ***B41J 29/38*** | (2006.01) |

(52) U.S. Cl. ..... 400/624; 400/578; 400/629; 347/218

(58) Field of Classification Search ..... None
See application file for complete search history.

(56) References Cited

U.S. PATENT DOCUMENTS

| | | | | |
|---|---|---|---|---|
| 6,738,596 | B1 * | 5/2004 | Kamimura et al. | 399/396 |
| 6,816,685 | B1 * | 11/2004 | Eda | 399/16 |
| 6,978,113 | B1 * | 12/2005 | Kamimura et al. | 399/388 |
| 2002/0025206 | A1 * | 2/2002 | Takada | 399/394 |
| 2003/0095822 | A1 * | 5/2003 | Kamimura et al. | 399/396 |

FOREIGN PATENT DOCUMENTS

| | | | |
|---|---|---|---|
| JP | 60023251 A | * | 2/1985 |
| JP | 5-8896 | | 1/1993 |
| JP | 11079462 A | * | 3/1999 |
| JP | 2001-80794 | | 3/2001 |
| JP | 2001-80795 | | 3/2001 |

* cited by examiner

*Primary Examiner*—Daniel J. Colilla
(74) *Attorney, Agent, or Firm*—Armstrong, Kratz, Quintos, Hanson & Brooks, LLP

(57) ABSTRACT

The present invention provides an image forming device comprising a first roller mechanism for sending out printing paper from a paper feed tray accommodating the printing paper therein, a second roller mechanism for transporting the printing paper to a printing start position where formation of an image on the paper is started, and a power supply mechanism for giving power to the first roller mechanism and the second roller mechanism. The device transports the printing paper at a first transport speed from an accommodated position inside the feed tray to a first position where the paper is transportable by the second roller mechanism, by driving the first roller mechanism, discontinues the driving of the first roller mechanism by the power supply mechanism upon the printing paper reaching the first position, transports the printing paper from the first position to a second position where the paper is taken out of the feed tray at a second transport speed lower than the first transport speed by driving the second roller mechanism, and transports the printing paper from the second position to the printing start position at a third transport speed higher than the second transport speed by driving the second roller mechanism.

10 Claims, 5 Drawing Sheets

IMAGE FORMING DEVICE

DESCRIPTION

1. Technical Field

The present invention relates to image forming devices such as printers, copying machines or facsimile devices.

2. Background Art

Printing operations are performed by image forming devices, such as printers, copying machines or facsimile devices, for forming images on printing paper. Sheets of printing paper for forming images thereon are placed as stacked up in a paper feed tray. The image forming device sends out sheets of printing paper from the paper feed tray one by one, transports the sheet to a printing start position where the formation of an image is started, and thereafter forms the image while moving the sheet suitably.

Various types of image forming devices are available, while various image forming methods including the thermal transfer method, laser method and ink jet method are used by image forming devices. However, regardless of the type of image forming devices or the kind of image forming methods, the means included in image forming devices for transporting printing paper generally comprise a first roller mechanism for sending out printing paper from a paper feed tray, and a second roller mechanism for transporting the printing paper, as sent out of the feed tray some distance, to the printing start position.

The first roller mechanism includes a roller which is adapted to be in pressing contact with one end portion of the uppermost of the sheets of printing paper placed in the paper feed tray. When the first roller mechanism is driven, the sheet of printing paper in the uppermost position is sent out in a predetermined feed direction owing to the friction between the roller and the printing paper. The sheet moves along a guide mechanism and is transported to a position where the sheet can be transported by the second roller mechanism. The second roller mechanism is thereafter driven, whereby the sheet is delivered from the feed tray and brought to the printing start position.

When the roller of the first roller mechanism is rotatingly driven, the sheet of printing paper positioned beneath the sheet in the uppermost position is likely to be sent out along with the uppermost sheet owning to the friction between the sheets, hence the likelihood of double sheet transport. Conventional image forming devices are adapted to prevent such double sheet transport. For example, an image forming device is available wherein the first roller mechanism is provided with a lift mechanism. With this device, double sheet transport is prevented by operating the lift mechanism to mechanically release the printing paper from the pressure of the roller of the second roller mechanism when the second roller becomes ready to transport the printing paper. However, the provision of the lift mechanism makes the image forming device complex in construction and results in a great increase in cost.

Also available is an image forming device wherein the roller of the first roller mechanism is brought out of rotation after it becomes possible for the second roller mechanism to transport the printing paper. Nevertheless, this procedure still remains to be improved in reliably precluding double printing sheet transport. Especially in the case where the printing sheet is transported as curled from the feed tray to the printing start position, double sheet transport is very likely to occur even if the procedure is conducted.

In view of the above problems, it is conventional practice to transport the printing paper by the first roller mechanism to a position where the paper can be transported by the second roller mechanism, and to thereafter drive the second roller mechanism to transport the paper at a considerably lower speed than the speed of transport by the first roller mechanism while discontinuing the operation of the first roller mechanism (see, for example, the publication of JP-A No. 2001-807949.

The possibility of double sheet transport is reduced by transporting the printing paper to the printable position at a low speed in this way, whereas this gives rise to the problem of necessitating a longer period of time for transporting the printing paper. In almost all cases, the user operates the image forming device for producing prints in succession, so that a prolonged period of time needed to transport the printing paper is considerably disadvantageous to the user.

The present invention has overcome the above problems and provides an image forming device which is reduced in the possibility of double printing sheet transport while suppressing an increase in the time required for the transport of printing paper, and a method of transporting printing paper.

SUMMARY OF THE INVENTION

The present invention provides an image forming device comprising a first roller mechanism for sending out printing paper from a paper feed tray accommodating the printing paper therein, a second roller mechanism for transporting the printing paper to a printing start position where formation of an image on the paper is started, and a power supply mechanism for giving power to the first roller mechanism and the second roller mechanism. The device transports the printing paper at a first transport speed from an accommodated position inside the feed tray to a first position where the paper is transportable by the second roller mechanism, by driving the first roller mechanism, discontinues the driving of the first roller mechanism by the power supply mechanism upon the printing paper reaching the first position, transports the printing paper from the first position to a second position where the paper is taken out of the feed tray at a second transport speed lower than the first transport speed by driving the second roller mechanism, and transports the printing paper from the second position to the printing start position at a third transport speed higher than the second transport speed by driving the second roller mechanism.

The present invention further provides a method of transporting printing paper including the steps of: transporting the printing paper at a first transport speed from an accommodated position inside a paper feed tray to a first position where the paper is transportable by a second roller mechanism, by driving a first roller mechanism, discontinuing the driving of the first roller mechanism by a power supply mechanism upon the printing paper reaching the first position, transporting the printing paper from the first position to a second position where the paper is taken out of the feed tray at a second transport speed lower than the first transport speed by driving the second roller mechanism, and transporting the printing paper from the second position to a printing start position at a third transport speed higher than the second transport speed by driving the second roller mechanism.

When the printing paper is brought to the first position where the paper is transportable by rotatingly driving the second roller mechanism, the first roller mechanism is brought out of rotation. The printing paper is transported from the first position to the second position where the paper is taken out of the feed tray, at a second transport speed lower than the first speed of transport by the first roller mechanism, by driving the second roller mechanism. This reduces the possibility of double sheet transport. The printing paper is further transported from the second position to the printing start position at a third transport speed higher than the second transport speed by driving the second roller mechanism, whereby the printing paper is brought to the printing start position more promptly than in conventional image forming devices. Thus, the present invention reduces the likelihood of double printing sheet transport while suppressing an increase in the time required for the transport of printing paper. Incidentally, the first roller mechanism or the second roller mechanism may comprise a plurality of rollers. Especially, the second roller mechanism may be a plurality of rollers which are arranged along the path of transport of the printing paper and which are drivable independently.

To effectively reduce the possibility of double printing sheet transport in the device described above, it is desirable that the second transport speed be not higher than one half of the first transport speed. If the printing paper is transported at a high speed when images are formed on the paper, the images to be formed become degraded. Accordingly, it is then desirable to transport the printing paper at a fourth speed which is lower than the third transport speed.

DETAILED DESCRIPTION OF THE INVENTION

An image forming device of the invention will be described with reference to the drawings. Although the present invention will be described below with reference to a thermal transfer printer embodying the invention, the present invention is widely applicable to image forming devices other than printers, such as copying machines, facsimile devices or like devices wherein images are formed on printing paper, and also to image forming devices other than those of the thermal transfer type.

Figure 1:
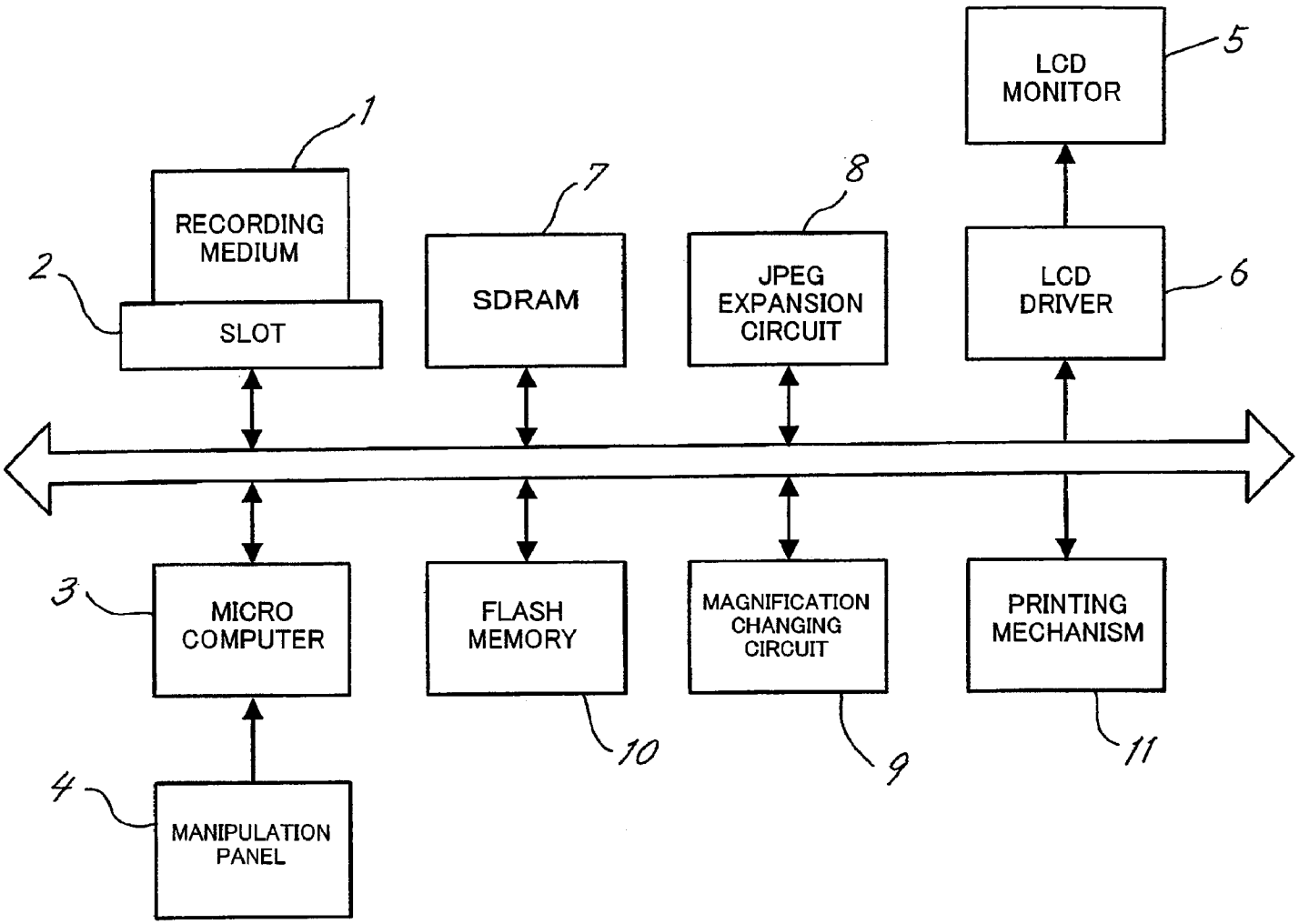
FIG. 1 is a block diagram showing the general construction of a printer as an embodiment of the invention.

FIG. 1 is a block diagram showing the general construction of a printer as an embodiment of the present invention The printer has a slot 2 for removably inserting a recording medium 1 into the printer therethrough. The recording medium 1 has recorded thereon image data captured by an image pickup device such as a digital still camera. Useful as the recording medium 1 is, for example, an SD memory card or like recording medium carrying a small-sized IC chip. The printer processes the image data recorded on the medium 1 to print images represented by the image data on printing paper.

A microcomputer 3 controls the operation of the printer and performs various kinds of processing. The microcomputer 3 comprises a CPU for performing arithmetic operation, etc., ROM for storing control programs and RAM for temporarily storing control programs to be executed by the CPU and various items of data. (CPU, ROM and RAM are not shown.) The microcomputer 3 has connected thereto a manipulation panel 4 provided with various manual keys. An LCD monitor 5 serving as a display unit is adapted to show thereon various setting frames for selecting the operation mode of the printer, the image to be printed, etc. In response to a command from the microcomputer 3, an LCD driver 6 drives the LCD monitor 5.

The image data as to an image selected by the user is read from the recording medium 1 and developed on SDRAM (Synchronous Dynamic Random Access Memory) 7. Image data is compressed by the JPEG method. A JPEG expansion circuit 8 expands the image data developed on the SDRAM 7. When required, the image data processed for expansion is fed to a magnification changing circuit 9 for magnification changing processing, i.e., for enlargement (interpolation) processing or reduction (thinning) processing.

A flash memory 10 has stored therein characters, numerals and like font data for use in printing additional data, such as the date of taking pictures, along with images, and data as to the history of use of the image forming device. The microcomputer 3 reads the font data from the flash memory 10 and combines the data with the image data developed on the SDRAM 7 to eventually prepare data as to the image to be formed on the printing paper (hereinafter referred to as "printing data"). The printing data is read from the SDRAM 7 and then sent to a printing mechanism 11. The image represented by the image data is formed on the printing paper by the printing mechanism 11. For example, photographic paper of the size of postcard is used as the printing paper. The microcomputer 3 reads the printing data from the SDRAM 7 and controls the printing mechanism 11.

Figure 2:
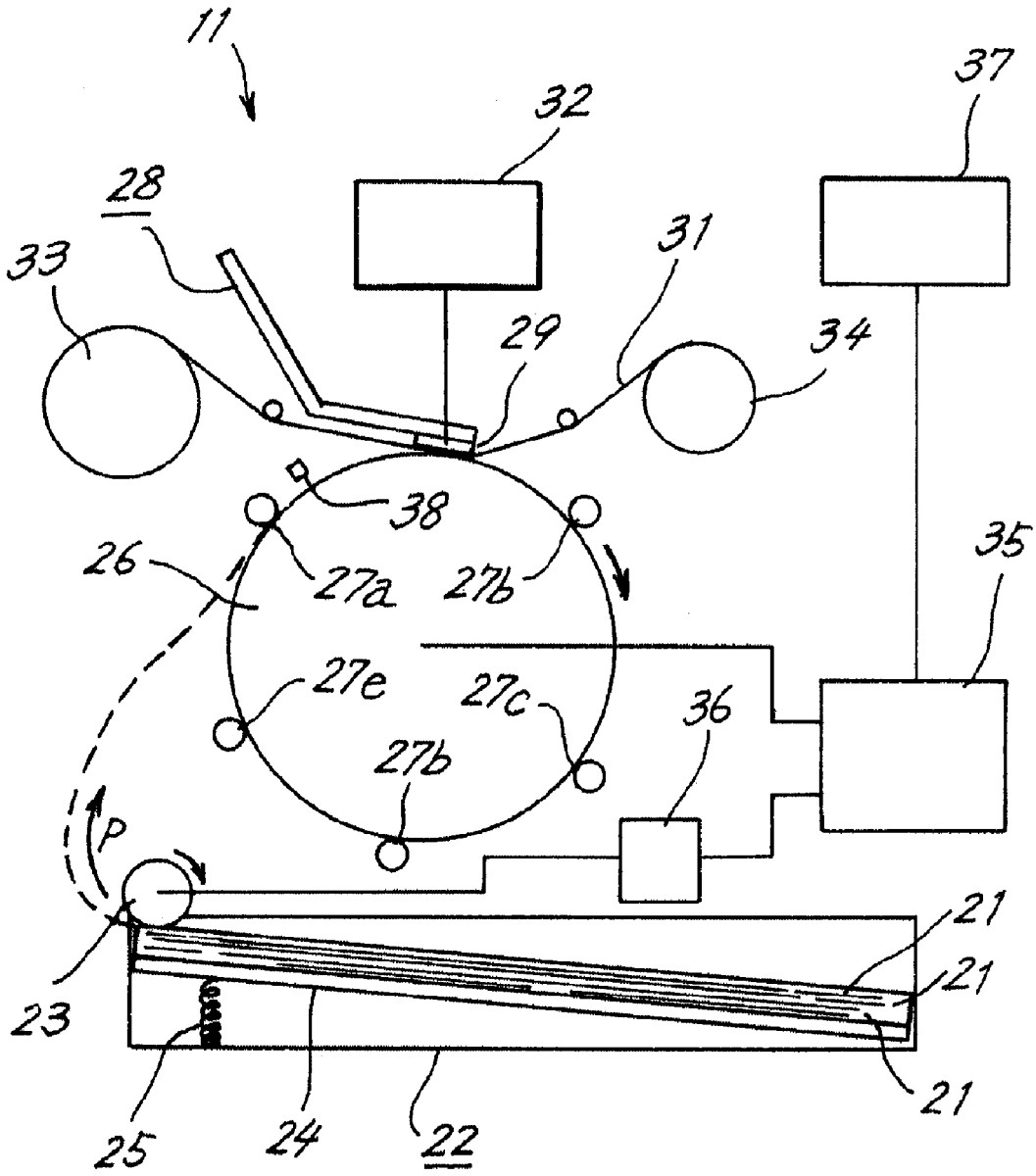
FIG. 2 is a diagram for illustrating the construction of a printing mechanism of the printer.

FIG. 2 is a diagram for illustrating the construction of the printing mechanism 11. Sheets of printing paper 21 are placed as stacked up in a paper feed tray 22. These sheets 21 are placed in the tray 22 so as to be movable upward along the direction of transport. In the vicinity of the outlet end of the paper feed tray 22, a paper feed roller 23 is disposed in pressing contact with the sheet of printing paper 21 in the uppermost position. Provided inside the feed tray 22 is a plate 24 for placing the printing paper 21 thereon. The plate 24 is biased upward by a spring member 25 to press the stack of printing paper 21 against the feed roller 23. The sheet of printing paper 21 in the uppermost position is sent out in the direction P of transport shown in FIG. 2 by the rotation of the feed roller 23.

The printer of the present embodiment uses the method of forming an image on the printing paper 21 as wound around a hollow cylindrical platen roller 26 by rotating the platen roller 26. The platen roller 26 has such a size that the sheet of printing paper 21 can be wound therearound without overlapping another sheet. To compact the printer, the platen roller 26 is disposed above the paper feed tray 22, and the printing paper 21 sent out of the tray 22 is curved upward along an unillustrated guide mechanism. FIG. 2 shows the path of transport of the printing paper 21 in a broken line.

Arranged around the platen roller 26 are five transport pinch rollers 27*a–e* for holding the paper 21 around the platen roller 26 and guiding the paper 21 for transport. These transport pinch rollers 27*a–e* are movable radially of the platen roller 26 at least by an amount corresponding to the thickness of the printing paper 21. The pinch rollers 27*a–e* are biased toward the platen roller 26 with a suitable force. Accordingly, the pinch rollers 27*a–e* are pressed into contact with the outer peripheral surface of the platen roller 26 when no paper is inserted between the roller 26 and these pinch rollers.

When the printing paper 21 is transported along the guide mechanism, the leading end of the paper 21 is nipped between the transport pinch roller 27*a* included among the five pinch rollers 27*a–e* and the platen roller 26. The platen roller 26 is covered with silicone rubber or like friction material over the outer peripheral surface thereof. When the platen roller 26 is rotated with the leading end of the printing paper 21 nipped between the transport pinch roller 27*a* and the platen roller 26, the leading end of the paper 21 therefore moves under a thermal head 28 and further moves beneath the other pinch rollers 27*b–e* in succession. In this way, the printing paper 21 is wound around the platen roller 26 while being held by the transport pinch rollers 27*a–e*. Although not shown, a plurality of members are arranged around the platen roller 26 for preventing the printing paper 21 from rising off the outer peripheral surface of the roller 26. For example, serving as these members are circular-arc plates shaped to extend along the outer peripheral surface of the platen roller 26. These members are arranged between the pinch rollers 27*a–e*.

The thermal head 28 is made movable toward or away from the platen roller 26 by a lift mechanism (not shown) controllable by the microcomputer 3. The platen roller 26 is brought out of rotation when the leading end portion of the printing paper 21 wound around the platen roller 26 is positioned under a heat generating portion 29 of the thermal head 28 as moved away from the platen roller (that is, when the paper 21 is brought to the printing start position). Disposed between the heat generating portion 29 of the thermal head 28 and the platen roller 26 is a thermal transfer ribbon 31 bearing thereon color pigments of Y (yellow), M (magenta) and C (cyan) as arranged periodically. After the platen roller 26 has stopped rotating, the thermal head 28 is brought close to the platen roller 26 at the printing start position. The heat generating portion 29 is pressed against the leading end portion of the printing paper 21 with the transfer ribbon 31 interposed therebetween.

The heat generating portion 29 is connected to a thermal head driver 32 to be controlled by the microcomputer 3. The driver 32 causes a group of heat generating elements constituting the heat generating portion 29 to generate heat based on the printing data sent to the printing mechanism 11. The region of the thermal transfer ribbon 31 bearing the yellow pigment ink thereon is first positioned beneath the heat generating portion 29 as pressed against the printing paper 21. When heat is produced by the heat generating portion 29, the yellow pigment ink is transferred to part of the printing paper 21. A yellow image is formed on the paper 21 by the rotation of the platen roller 26 and the transfer of the pigment ink.

The thermal transfer ribbon 31 is wound around a supply reel 33 and has one end connected to a take-up reel 34. After the yellow image has been formed on the paper 21, the thermal head 23 is moved away from the platen roll, and these reels 33, 34 are driven to transport the transfer ribbon 31, whereby the transfer ribbon 31 has its magenta pigment ink bearing portion positioned beneath the heat generating portion 29. The printing paper 21 is thereafter brought to the printable position again, and the heat generating portion 29 is pressed against the leading end portion of the paper 21 with the transfer ribbon 31 held therebetween. The platen roller 26 then rotates to form a magenta image on the paper 21. Finally, a cyan image is similarly formed on the paper 21 to produce a color image on the printing paper 21.

The paper feed roller 23 and the platen roller 26 are connected to a drive motor 35 by an unillustrated power transmission mechanism. When operated, the drive motor 35 rotatingly drives the paper feed roller 23 and the platen roller 26. A clutch 36 is provided between the feed roller 23 and the drive motor 35. When the clutch 36 is disengaged, the paper feed roller 23 is brought out of rotation, and the platen roller 26 only can be driven. The clutch 36 is controlled by the microcomputer 3. A stepping motor is used as the drive motor 35. Based on a command given by the microcomputer 3, a motor driver 37 feeds drive pulses to the drive motor 35.

A sensor 38 is provided on the thermal head side in the vicinity of the transport pinch roller 27*a* by which the leading end of the paper 21 forwarded from the tray 23 is held first. The sensor 38 detects the arrival of the leading end of the paper 21 at a predetermined position in the vicinity of the pinch roller 27*a*, thus detecting the paper 21 as positioned in contact with the platen roller 26 and made ready for transport by the roller 26, and feeds to the microcomputer 3 a signal indicating the result of detection.

Figure 3:
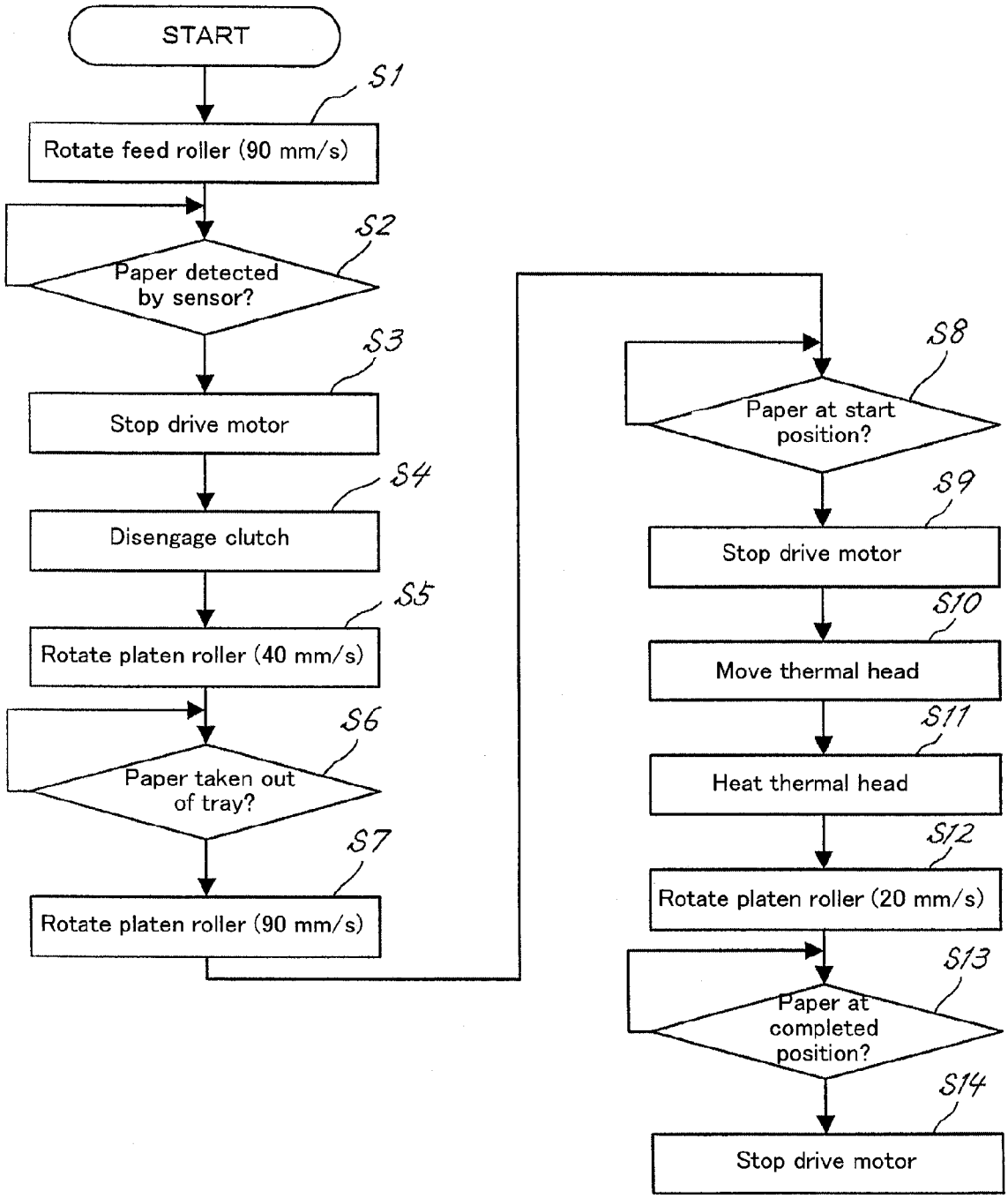
FIG. 3 is a flow chart showing a transport operation of the printer.
Figure 4C:
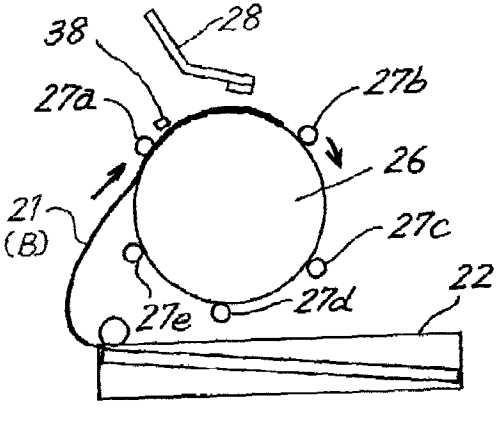
FIGS. 4A to 4E are diagrams schematically showing the state of the printing mechanism during the transport operation of the printer.
Figure 4B:
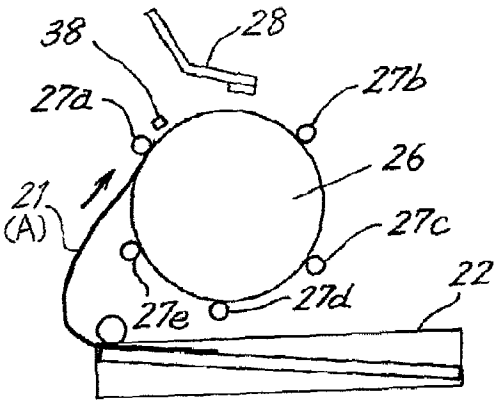

Described next is the operation of transporting the printing paper 21 in the printer of the present embodiment. FIG. 3 is a flow chart showing this transport operation, i.e. a procedure for forming an image of the first color (yellow) on the printing paper 21 after the paper is sent out of the feed tray 22. FIGS. 4A to 4E are diagrams for schematically illustrating the state of the printing mechanism 11 during the transport of the paper 21. FIG. 5 is a timing chart showing the speed of transport of the printing paper 21 by the rotation of the feed roller 23 and the speed of transport of the paper 21 by the rotation of the platen roller 26.

Figure 4A:
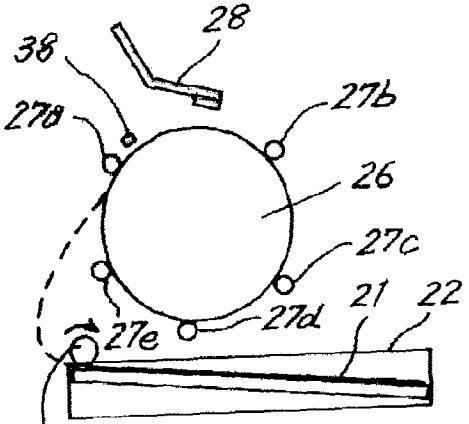
Figure 5:
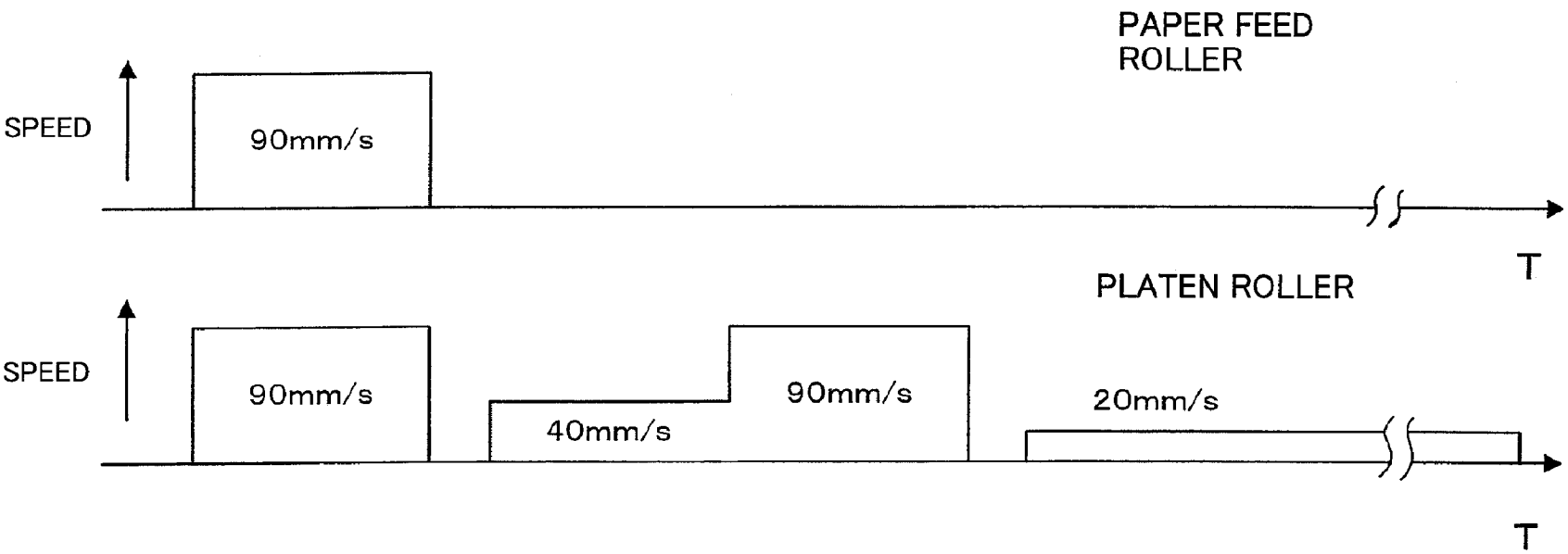
FIG. 5 is a timing chart showing the speed of transport of printing paper by a paper feed roller during the operation of the printer and the speed of transport of the printing paper by a platen roller in rotation.

First in the initial state shown in FIG. 4A (with the printing paper 21 to be transported placed in the feed tray 22), the user manipulates the manipulation panel 4 to select and start a printing operation. The microcomputer 3 causes the motor driver 37 to rotatingly drive the feed roller 23 so as to send out the paper 21 at a predetermined transport speed, i.e., at a transport speed of 90 mm/s, from the feed tray 22 (S1). In addition to the feed roller 23, the platen roller 26 is also rotatingly driven at the same time to give the roller a transport speed of 90 mm/s as shown in FIG. 5.

The printing paper 21 advances toward the platen roller 26 at the transport speed of 90 mm/s along the transport path along the unillustrated guide mechanism. The leading end of the paper 21 is nipped between the transport pinch roller 27*a* and the platen roller 26 and thereafter reaches the position to be detected by the sensor 38. Thus, the paper 21 is brought into a state A in which the paper can be transported by the rotation of the platen roller 26 (see FIG. 4B). According to the present embodiment, the feed roller 23 and the platen roller 26 are rotatingly driven at the same transport speed, so that the leading end of the paper 21 smoothly moves into a space between the pinch roller 27*a* and the platen roller 26. Incidentally, a clutch or the like may be provided between the drive motor 35 and the platen roller 26 to rotatingly drive the platen roller 26 when the leading end of the printing paper 21 is brought close to the pinch roller 27*a* unlike the timing chart of FIG. 5.

The microcomputer 3 checks whether the sensor 38 has detected the printing paper 21 (S2). If a signal indicating the detection of the paper 21 is sent from the sensor 38, the microcomputer 3 causes the motor driver 37 to stop the drive motor 35 (S3). FIG. 4B shows the state of the printing mechanism 11 when the motor 35 is brought to a halt. The printing paper 21 has not been completely taken out of the feed tray 22, with the rear end portion of the paper remaining in the tray 22. The clutch 36 is thereafter disengaged by the microcomputer 3 to hold the feed roller 23 out of rotation even if the drive motor 35 is operated (S4).

After step S4, the microcomputer 3 causes the motor driver 37 to operate the drive motor 35 to rotatingly drive the platen roller 26 at a lower transport speed than in step S1, i.e., at a transport speed of 40 mm/s, for the transport of the paper 21 (S5). The paper 21 is transported at the speed of step S5 until the paper is completely moved out of the feed tray 22 as indicated at B (until the paper is completely moved out of contact with the feed roller 23). FIG. 4C shows the state of the printing mechanism 11 upon the paper 21 being moved out of the tray 23.

The microcomputer 3 inquires whether the printing paper 21 has been completely sent out of the feed tray 22 (S6). Stated more specifically, the microcomputer 3 checks whether the number of drive pulses given to the drive motor 35 after step S5 is started has reached a predetermined number required to transport the paper 21 from state A to state B. If the paper 21 is found in step S6 to have been completely moved out of contact with the feed roller 23, the microcomputer 3 causes the motor driver 37 to operate the drive motor 35 to rotatingly drive the platen roller 26 at a higher transport speed than in step S5, i.e., at a transport speed of 90 mm/s, for the transport of the paper 21 (S7). According to the present embodiment, the speed of transport of the paper 21 in step S7 is made equal to the speed of transport in step S1 but need not always be so determined.

Figure 4E:
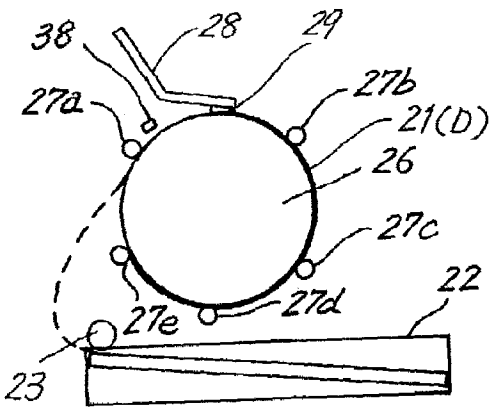
Figure 4D:
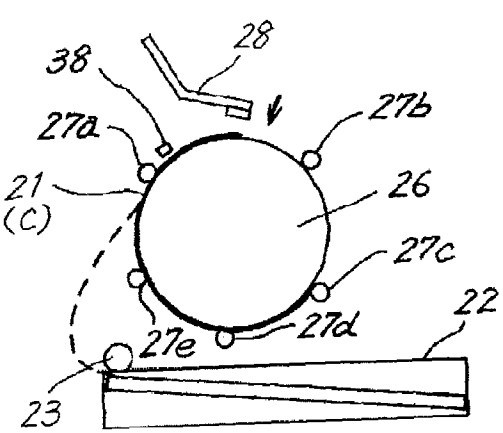

The printing paper 21 is transported at the speed of step S7 until the paper 21 is brought into a state C as located at the printing start position. FIG. 4D shows the state of the printing mechanism 11 when the paper 21 is brought to the printing start position. The microcomputer 3 inquires whether the paper 21 has been brought to the printing start position (S8). Stated more specifically, the microcomputer 3 checks whether the number of drive pulses given to the drive motor 35 after step S7 is started has reached a predetermined number required to transport the paper 21 from state B to state C. If the paper 21 is found in step S8 to have been brought to the printing start position, the microcomputer 3 stops the drive motor 35 (S9).

Next, the microcomputer 3 drives the unillustrated thermal head lift mechanism to bring the thermal head 28 close to the platen roller 26 (S10). This presses the heat generating portion 29 of the thermal head 28 against the leading end portion of the printing paper 21 as located at the printing start position, with the thermal transfer ribbon 31 interposed between the portion 29 and the paper. Based on the printing data sent from the SDRAM 7, the thermal head driver 32 causes the heat generating elements constituting the heat generating portion 29 to produce heat (S11), and the microcomputer 3 causes the motor driver 37 to rotatingly drive the platen roller 26 at a lower transport speed than in step S7 (and than in steps S1 and S5), i.e., at a transport speed of 20 mm/s, for the transport of the paper 21 (S12), whereby a yellow image is formed on the printing paper 21.

The printing paper 21 is transported at the speed of step S12 until the paper is brought into a state D as located at a printing completed position (with the heat generating portion 29 positioned on the rear end portion of the printing paper 21). FIG. 4E shows the state of the printing mechanism 11 when the printing paper 21 is brought to the printing completed position. The microcomputer 3 inquires whether the printing paper 21 has been brought to the printing completed position (S13). Stated more specifically, the microcomputer 3 checks whether the number of drive pulses given to the drive motor 35 after step S12 is started has reached a predetermined number required to transport the paper 21 from state C to state D. If the paper 21 is found in step S13 to have been brought to the printing completed position, the microcomputer 3 stops the drive motor 35 (S14).

The thermal head 28 is thereafter moved away from the platen roller 26, and the thermal transfer ribbon 31 is forwarded as already described above. The printing paper 21 is then brought to the printing start position again. The procedure of step S10 to step S14 thereafter follows to form a magenta image on the paper 21, and a cyan image is further formed similarly. Consequently, a color image represented by the printing data is produced on the printing paper 21.

Although a single drive motor 35 is used as power supply means according to the above embodiment, the feed roller 23 and the platen roller 26 may be driven individually with use of respective drive motors. The image forming device to which the present invention is applicable is not limited to an image forming device wherein printing paper 21 is wound around a platen roller 26 like the above embodiment, or to an image forming device wherein a platen roller 26 is used for transporting printing paper 21 to the printing start position. For example, the present invention may be embodied as an image forming device wherein printing paper is transported to the printing start position by driving a roller disposed between a paper feed roller and a platen roller, or by driving such a roller and the platen roller, and an image is formed on the paper by moving the paper straight on the platen roller. Further according to the procedure shown in FIGS. 3 to 5, the number of drive pulses supplied to the drive motor 35 is counted in step S6, S8 or S13 to check the position of the printing paper 21, whereas the position of the paper 21 may be checked with use of the data obtained from a sensor for detecting the position of the paper 21.

The embodiment described above is intended to illustrate the present invention and should not be construed as limiting the invention set forth in the appended claims or reducing the scope thereof. The device of the invention is not limited to the foregoing embodiment in construction but can of course be modified variously within the technical scope defined in the claims.

What is claimed is:

1. An image forming device comprising a first roller mechanism for sending out printing paper from a paper feed tray accommodating the printing paper therein, a second roller mechanism for transporting the printing paper to a printing start position where formation of an image on the paper is started, and a power supply mechanism for giving power to the first roller mechanism and the second roller mechanism, the image forming device being characterized by transporting the printing paper at a first transport speed from an accommodated position inside the feed tray to a first position where the paper is transportable by the second roller mechanism, by driving the first roller mechanism, discontinuing the driving of the first roller mechanism by the power supply mechanism upon the printing paper reaching the first position, transporting the printing paper from the first position to a second position where the paper is taken out of the feed tray at a second transport speed lower than the first transport speed by driving the second roller mechanism, and transporting the printing paper from the second position to the printing start position at a third transport speed higher than the second transport speed by driving the second roller mechanism.

2. An image forming device according to claim 1 wherein the second transport speed is not higher than one half of the first transport speed.

3. An image forming device according to claim 1 wherein the image is formed on the printing paper while transporting the printing paper at a fourth transport speed lower than the third transport speed by driving the second roller mechanism.

4. An image forming device according to claim 1 wherein the second roller mechanism is a platen roller.

5. An image forming device according to claim 4 which comprises a thermal head and a thermal transfer ribbon interposed between the thermal head and the printing paper, and wherein the printing paper is wound around the second roller mechanism before the paper is brought from the second position to the printing start position, and the image is formed on the printing paper by pressing a heat generating portion of the thermal head against a leading end portion of the printing paper with the thermal transfer ribbon interposed therebetween at the printing start position, and thereafter causing the heat generating portion to produce heat and driving the second roller mechanism.

6. A method of transporting printing paper including the steps of:

transporting the printing paper at a first transport speed from an accommodated position inside a paper feed tray to a first position where the paper is transportable by a second roller mechanism, by driving a first roller mechanism, discontinuing the driving of the first roller mechanism by a power supply mechanism upon the printing paper reaching the first position, transporting the printing paper from the first position to a second position where the paper is taken out of the feed tray at a second transport speed lower than the first transport speed by driving the second roller mechanism, and transporting the printing paper from the second position to a printing start position at a third transport speed higher than the second transport speed by driving the second roller mechanism.

7. A method according to claim 6 wherein the second transport speed is not higher than one half of the first transport speed.

8. A method according to claim 6 wherein an image is formed on the printing paper while transporting the printing paper at a fourth transport speed lower than the third transport speed by driving the second roller mechanism.

9. A method according to claim 6 wherein the second roller mechanism is a platen roller.

10. A method according to claim 9 which further includes the steps of:

winding the printing paper around the second roller mechanism before the paper is brought from the second position to the printing start position, and forming an image on the printing paper by pressing a heat generating portion of a thermal head against a leading end portion of the printing paper with a thermal transfer ribbon interposed therebetween at the printing start position, and thereafter causing the heat generating portion to produce heat and driving the second roller mechanism.

* * * * *